United States Patent [19]

Lemelson

[11] 4,121,794

[45] Oct. 24, 1978

[54] FLYING TOY

[76] Inventor: Jerome H. Lemelson, 85 Rector St., Metuchen, N.J. 08840

[21] Appl. No.: 809,781

[22] Filed: Jun. 24, 1977

[51] Int. Cl.[2] ..... B64C 31/06

[52] U.S. Cl. ..... 244/153 A

[58] Field of Search ..... 244/153 R, 153 A, 154; D34/15 AF

[56] References Cited

U.S. PATENT DOCUMENTS

| | | | |
|---|---|---|---|
| D160,910 | 11/1950 | Wolford | 244/153 A X |
| D232,572 | 8/1974 | Torsak | D34/15 AF |
| 2,494,430 | 1/1950 | Carnwath | 244/153 A |
| 3,079,115 | 2/1963 | Edwards et al. | 244/153 A |
| 3,255,985 | 6/1966 | Albertson | D34/15 AF |

FOREIGN PATENT DOCUMENTS

| | | | |
|---|---|---|---|
| 953,276 | 3/1964 | United Kingdom | 244/153 A |

*Primary Examiner*—Barry L. Kelmachter

[57] ABSTRACT

A flying toy or kite is provided which generates lift by spinning as it rotates at the end of a loop of string. The toy is molded of foamed plastic, preferably of two major components including a wing to spin about a lateral axis and a disc-shaped central fin attached to the center of the wing. The wing has a molded channel forming receptacle for a dowel or tube which extends along the central portion of the wing and retains rotating fittings at its ends. The disc has a molded slot for receiving the wing and is increased in thickness adjacent the slot to provide suitable support for the wing and to improve its strength and resistance to damage.

5 Claims, 4 Drawing Figures

FLYING TOY

SUMMARY OF THE INVENTION

This invention relates to flying toys and in particular to kites which derive their lift by the rotation of a flight surface about an axis on the end of a string.

Rotating kites are known in the art which derive at least part of their lift by the wind blown rotation of one or more of their components. U.S. Pat. No. 3,079,115 discloses such a kite having a surface structure which includes a disc formed of an easily bendable material such as cardboard and a wing formed of flat sheet material which is bent or deformed by hand to make it conform to the particular shape desired as defined by slotted openings through the disc when assembled therewith.

The instant invention is drawn to a kite of the type disclosed in said U.S. patent but it is molded of a lightweight expanded plastic and contains structural improvements therein which facilitate and improve assembly of the kite and thereby lower the cost of producing same. Futhermore, such structural improvements result in improvements in strength and resistance of the kite structure to deterioration and destruction during use.

Accordingly, it is a primary object of this invention to provide a new and improved toy flying kite which is formed of lightweight expanded plastic.

Another object is to provide a kite which is made of at least two major components which are moded of expanded plastic and may be shipped flat facilitating packaging.

Another object is to provide a kite formed of an assembly of components defined by a wing and a stabilizing disc, both of which are molded of lightweight expanded plastic and each is shaped to facilitate their assembly and to frictionally retain the assembly even during times when strong wind forces are applied thereto.

Another object is to provide a kite assembly of a molded wing and a thin disc wherein the disc contains a diametral slotted opening for frictionally accommodating the wing and wherein the disc has a molded portion of increased thickness adjacent the slotted opening for improving the strength of the disc where it is weakened by the opening and also operable for better frictionally supporting and retaining the wing.

Another object is to provide a flying toy having a wing portion which spins on fittings supported at the ends of a dowel or tube spanning the wing, wherein the wing is specially shaped to accommodate and predeterminately position the dowel or tube thereon.

Another object is to provide a flying toy having wing portion having its tips specially shaped to accommodate retainers for fittings on which the wing may rotate.

With the above and such other objects in view as may hereinafter more fully appear, the invention consists of the novel methods, constructions, combinations and arrangements of parts as will be more fully described and illustrated in the accompanying drawings, but it is to be understood that changes, variations and modifications may be resorted to which fall within the scope of the invention as claimed.

Figure 1:
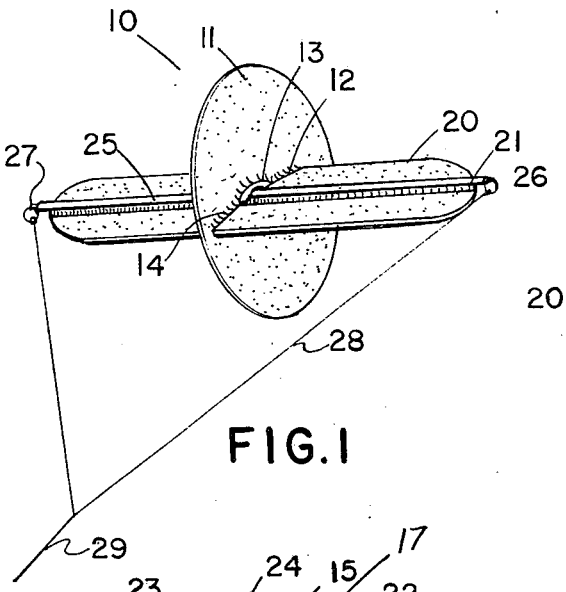
FIG. 1 is an isometric view of a kite which derives at least part of its lift by spinning about a lateral axis between the ends of a loop of string.

In FIG. 1 is shown a flying toy or kite assembly 10 formed of a lightweight disc 11 and a wing 20 assembled at right angles to each other, wherein the disc 11 is chordwise secured to the center of the wing as shown. The wing and disc are preferably molded from plastic which is expanded from molten resin or is originally introduced as expandable pellets into the mold and expanded therein to form respective cellular plastic sheet-like formations or structures which will provide sufficient lightness to permit lift generated when the assembly 10 spins to overcome the weight of the assembly.

Wing 20 is shown frictionally retained in a slotted opening 12 in the disc 11 which opening is preferably molded therein diametrically across the disc. Such a slotted opening substantially weakens the disc and to accommodate such weakening and strengthen the structure of the disc, an increase in its thickness is provided along its diametral portion thereof containing the opening 12, such increased thickness section being referred to by the notation 14. The increased thickness section 14 also serves the function of increasing the supporting surface of the disc for the wing by increasing the total frictional force which holds the assembly together. The disc 11 is preferably tapered toward its circumferential edge to lighten it and reduce drag.

The wing 20 is also preferably tapered towards its peripheral edge and contains extending spanwise along the central portion thereof a molded rib-like or double rib formation 21 of increased thickness and formed of parallel ribs 22 and 23 with a channel 24 defined therebetween for accommodating a rigid strut 25 in the form of a dowl or tube which extends in the channel 24 across the entire wing and contains rotating fittings 26 and 27 secured to its ends. Tied to the fittings 26 and 27 is a loop 28 of string and secured to the center of the loop is a length 29 of string which extends to the ground and may vary from about 25 feet to 100 feet or more in length. As wind strikes the wing 20, it causes the assembly to rotate on the fittings 26 and 27 and in so doing, to generate lift sufficient to cause the kite assembly to rise a substantial distance above the ground.

Figure 2:
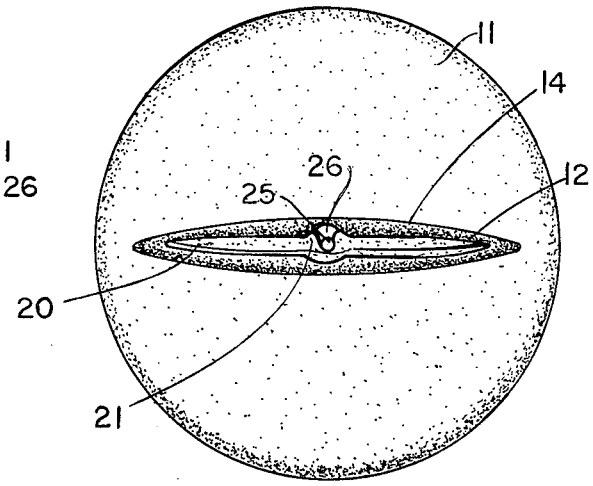
FIG. 2 is a side view of the kite assembly shown in FIG. 1.
Figure 4:
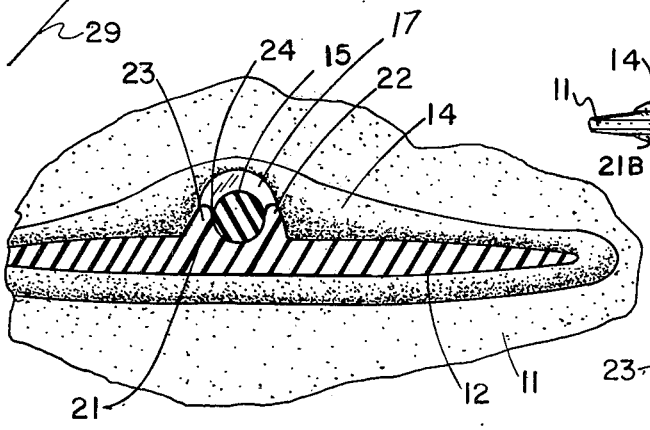
FIG. 4 is a partial view with parts broken away for clarity of the side of the kite of FIG. 1.

In FIG. 2, notation 13 refers to the central portion of the opening 12 which is shaped to accommodate the rib-like formations 22 and 23 and the dowel or tube 25 which is seated in the channel 24 of the wing.

Notation 15 refers to a molded plastic grommet of substantially greater rigidity than the rigidity of the cellular plastic forming the disc 11. The grommet 15 has a tubular shank which extends through the expanded portion 13 of the opening 12 and preferably frictionally engages the wall thereof to retain the grommet 15 in place. The interior passageway through the grommet 15 accommodates the dowel or rod 25, preferably in frictional assembly therewith and prevents movement of the wing with respect to the disc when forces are applied thereto. The head 17 of the grommet 15 preferably lies flat against and is supported by a substantial portion of the disc 11. The head 17 may be adhesively bonded to the surface of the disc 11 to which it is secured.

Figure 3:
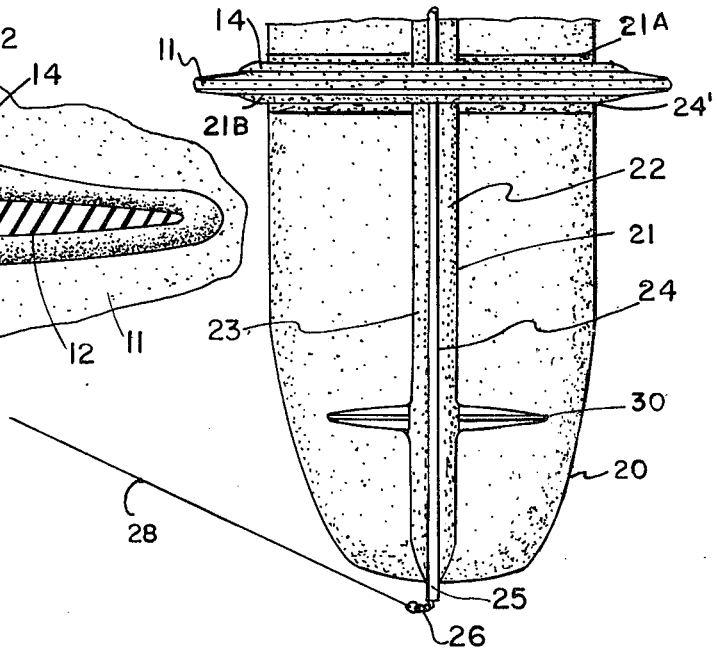
FIG. 3 is a plan view of a portion of the kite of FIGS. 1 and 2.

Also illustrated in FIG. 3 is an expanded portion at the center of the wing 20 defined by raised portions 21A and 21B which are space-separated from each other and define a shallow channel 24' therebetween. The shallow channel 24' may accommodate the interior wall portion of one side of the slotted opening 12 to prevent laterial shifting of the disc 11 along the wing 20 once it has been centered within said channel.

In FIG. 3 notation 30 refers to a shallow fin or rib molded in the upper and/or lower surface of the wing for reinforcement and flight stabilizing purposes.

I claim:

1. A kite toy comprising an elongated wing portion molded of lightweight cellular plastic, one surface of said wing portion having a channel retaining means molded integrally therein and extending spanwise along the central portion of the wing and a pair of raised portions extending in a chordwise direction and forming a chordwise shallow channel, an elongated dowel secured to said wing portion and supported within said channel retaining means, rotatable fitting means supported at each end of said dowel, a loop of flexible string secured to said rotatable fitting means, a kite string connected to the center of said loop, a disc-shaped molding having a radially extending slotted opening in the central portion thereof, said wing portion passing through said slotted opening so that said disc-shaped molding is supported by said chordwise shallow channel against lateral movement, said dowel extending through said slotted opening and said disc-shaped molding having a greater thickness at the slotted opening than the periphery of said molding.

2. A kite toy in accordance with claim 1 including a tubular fitting surrounding said dowel and extending through the central portion of said slotted opening in said disc-shaped molding.

3. A kit toy in accordance with claim 1 wherein said wing portion has tapered end portions.

4. A kite toy in accordance with claim 1 wherein said dowel has a length greater than the span of said wing portion.

5. A kite toy in accordance with claim 1 wherein the molded cellular plastics adjacent the center of said wing portion and said disc-shaped molding are configured to provide frictional assembly between the two when the disc-shaped molding is located at the center of said wing portion.

* * * * *